US005959648A

United States Patent [19]

Albinsson

[11] Patent Number: 5,959,648

[45] Date of Patent: Sep. 28, 1999

[54] DEVICE AND A METHOD FOR POSITIONING AN ARRAY OF CONTROL ELECTRODES IN A PRINTHEAD STRUCTURE FOR DIRECT ELECTROSTATIC PRINTING

[75] Inventor: Urban Albinsson, Mölndal, Sweden

[73] Assignee: Array Printers AB, Vastra Frolunda, Sweden

[21] Appl. No.: 08/757,278

[22] Filed: Nov. 27, 1996

[51] Int. Cl.[6] ..... B41J 2/06

[52] U.S. Cl. ..... 347/55; 347/141

[58] Field of Search ..... 347/55, 112, 141

[56] References Cited

U.S. PATENT DOCUMENTS

| | | |
|---|---|---|
| 3,566,786 | 3/1971 | Kaufer et al. . |
| 3,689,935 | 9/1972 | Pressman et al. . |
| 3,779,166 | 12/1973 | Pressman et al. . |
| 4,263,601 | 4/1981 | Nishimura et al. . |
| 4,274,100 | 6/1981 | Pond . |
| 4,353,080 | 10/1982 | Cross . |
| 4,384,296 | 5/1983 | Torpey . |
| 4,386,358 | 5/1983 | Fischbeck . |
| 4,470,056 | 9/1984 | Galetto et al. . |
| 4,478,510 | 10/1984 | Fujii et al. . |
| 4,491,794 | 1/1985 | Daley et al. . |
| 4,491,855 | 1/1985 | Fujii et al. ..... 347/55 |
| 4,498,090 | 2/1985 | Honda et al. . |
| 4,511,907 | 4/1985 | Fukuchi . |

(List continued on next page.)

FOREIGN PATENT DOCUMENTS

| | | |
|---|---|---|
| 12 70 856 | 6/1968 | Germany . |
| 26 53 048 | 5/1978 | Germany . |
| 44-26333 | 11/1969 | Japan . |
| 55-55878 | 4/1980 | Japan . |
| 55-84671 | 6/1980 | Japan . |
| 55-87563 | 7/1980 | Japan . |
| 58-044457 | 3/1983 | Japan . |
| 2108432 | 5/1983 | Japan . |
| 58-155967 | 9/1983 | Japan . |
| 62-13356 | 11/1987 | Japan . |
| 04189554 | 8/1992 | Japan . |
| 5208518 | 8/1993 | Japan . |
| 93331532 | 12/1993 | Japan . |
| 94200563 | 8/1994 | Japan . |
| 9048151 | 2/1997 | Japan . |
| 09118036 | 5/1997 | Japan . |
| 9014960 | 12/1990 | WIPO . |
| 9201565 | 2/1992 | WIPO . |

OTHER PUBLICATIONS

E. Bassous, et al., "The Fabrication of High Precision Nozzles by the Anisotropic Etching of (100) Silicon", *J. Electrochem. Soc.: Solid–State Science and Technology*, vol. 125, No. 8, Aug. 1978, pp. 1321–1327.

Jerome Johnson, "An Etched Circuit Aperture Array for TonerJet® Printing", *IS&T's Tenth International Congress on Advances in Non–Impact Printing Technologies*, 1994, pp. 311–313.

*Primary Examiner*—Arthur T. Grimley
*Assistant Examiner*—Quana Grainger
*Attorney, Agent, or Firm*—Knobbe, Martens, Olson & Bear, LLP

[57] ABSTRACT

A print head structure includes a support device which supports a flexible control unit in a predetermined position in the print head structure. The support device is in the form of a rigid trough-shaped frame having a longitudinal dimension and a transverse dimension and further having two longitudinally extending side walls. The support device further has a bottom portion between the two side walls, an outer surface and an inner surface. A longitudinally extending slot is provided in the bottom portion of the support device. The slot extends through the support device between the inner surface and the outer surface. The support device further includes a fastener for maintaining the flexible control unit in contact with the bottom portion of the support device. The flexible control unit bridges the slot in the bottom portion.

15 Claims, 4 Drawing Sheets

U.S. PATENT DOCUMENTS 4,525,727 6/1985 Kohashi et al. .
4,571,601 2/1986 Teshima .
4,675,703 6/1987 Fotland .
4,717,926 1/1988 Hotomi .
4,743,926 5/1988 Schmidlin et al. .
4,748,453 5/1988 Lin et al. .
4,814,796 3/1989 Schmidlin .
4,831,394 5/1989 Ochiai et al. .
4,837,071 6/1989 Tagoku et al. .
4,860,036 8/1989 Schmidlin .
4,912,489 3/1990 Schmidlin .
5,028,812 7/1991 Bartky .
5,036,341 7/1991 Larsson .
5,038,159 8/1991 Schmidlin et al. .
5,057,855 10/1991 Damouth .
5,072,235 12/1991 Slowik et al. .
5,083,137 1/1992 Badyal et al. .
5,121,144 6/1992 Larson et al. .
5,128,695 7/1992 Maeda .
5,148,595 9/1992 Doggett et al. .
5,170,185 12/1992 Takemura et al. .
5,181,050 1/1993 Bibl et al. .
5,204,696 4/1993 Schmidlin et al. .
5,204,697 4/1993 Schmidlin .
5,214,451 5/1993 Schmidlin et al. .
5,229,794 7/1993 Honman et al. .
5,237,346 8/1993 Da Costa et al. .
5,256,246 10/1993 Kitamura .
5,257,045 10/1993 Bergen et al. .
5,270,729 12/1993 Stearns .
5,274,401 12/1993 Doggett et al. .
5,307,092 4/1994 Larson .
5,402,158 3/1995 Larson .
5,450,115 9/1995 Bergen et al. .
5,473,352 12/1995 Ishida ..... 347/55
5,477,246 12/1995 Hirabayashi et al. .
5,506,666 4/1996 Masuda et al. .
5,515,084 5/1996 Larson .
5,617,129 4/1997 Chizuk, Jr. et al. .
5,625,392 4/1997 Maeda .
5,640,185 6/1997 Kagayama ..... 347/55
5,650,809 7/1997 Kitamura .
5,666,147 9/1997 Larson .

DEVICE AND A METHOD FOR POSITIONING AN ARRAY OF CONTROL ELECTRODES IN A PRINTHEAD STRUCTURE FOR DIRECT ELECTROSTATIC PRINTING

FIELD OF THE INVENTION

The present invention relates to image recording methods and devices and, more particularly, to a device for supporting and positioning an array of control electrodes in relation to a particle carrier to enhance the print quality of a direct electrostatic printing device.

DESCRIPTION OF RELATED ART

The most well known and widely utilized electrostatic printing technique is that of xerography wherein latent electrostatic images formed on a charge retentive surface, such as a roller, are developed by the use of a suitable toner material to render the images visible, the images being subsequently transferred to an information carrier.

This process is called an indirect process because it first forms a visible image on an intermediate surface and then transfers that image to an information carrier.

Another method of electrostatic printing is one that has come to be known as direct electrostatic printing. This method differs from the aforementioned xerographic method in that charged pigment particles (toner) are deposited directly onto an information carrier to form a visible image. In general, this method includes the use of electrostatic fields controlled by addressable electrodes for allowing passage of toner particles through selected apertures in a printhead structure. A separate electrostatic field is provided to attract the toner particles to an information carrier in an image configuration.

The distinguishing feature of direct electrostatic printing is its simplicity of simultaneous field imaging and particle transport to produce a visible image on the information carrier directly from computer generated signals, without the need for those signals to be intermediately converted to another form of energy such as light energy, as is required in electrophotographic printers, e.g. laser printers.

U.S. Pat. No. 5,036,341, granted to Larson, discloses a direct printing device and a method to produce text and pictures on an image receiving substrate directly from computer generated signals. According to that method, a control electrode array, formed of a latticework of individually controlled wires, is positioned between a back electrode and a rotating particle carrier. An image receiving substrate, such as paper, is then positioned between the back electrode and the control electrode array.

A uniform electric field is generated between a high potential on a back electrode and a low potential on a particle carrier to thereby attract the toner particles from the surface of the particle carrier and to create a particle stream toward the back electrode. The particle stream is modulated by a series of voltage sources which apply an electric potential to selected individual wires of the control electrode array to produce electrostatic fields which permit or restrict particle transport from the particle carrier. In effect, these electric fields "open" or "close" selected apertures in the control electrode array to the passage of toner particles by influencing the attractive force from the back electrode. The modulated stream of charged particles allowed to pass through selected apertures impinge upon a print receiving medium interposed in the particle stream to provide line-by-line scan printing to form a visible image.

The control electrode array described in the above mentioned patent is in the form of a lattice of individual wires arranged in rows and columns. A control electrode array operating according to the described principle may, however, take on any one of several other designs. Generally, the array is a thin sheet-like element, referred to as a Flexible Printed Circuit or FPC, comprising a plurality of addressable control electrodes and corresponding voltage signal sources connected thereto for attracting charged toner particles from the surface of a particle carrier to an information carrier. A sequence of electronic signals, defining the image information, is converted into a pattern of electrostatic fields which locally modify the uniform field from a back electrode, thereby selectively permitting or restricting the transport of charged particles from the particle carrier and producing an image pattern corresponding to the electrostatic field pattern onto the information carrier.

A flexible control array or FPC as disclosed in, for example, U.S. Pat. No. 5,121,144, also granted to Larson, is made of a flexible, electrically insulating, non-rigid material, such as polyimide or the like, which is provided with a multiplicity of apertures and is overlaid with a printed circuit whereby the apertures in the material are arranged in rows and columns and are surrounded by ring shaped electrodes. A uniform electrostatic field generated by a back electrode attracts toner particles from a particle source to create a particle stream through the FPC toward the back electrode. All control electrodes are initially at a white potential, $V_w$ which means that toner transport from the particle carrier toward the back electrode is inhibited. As image locations on an information carrier are made to pass beneath the apertures, selected control electrodes are set to a black potential $V_b$ to produce an electrostatic field drawing the toner particles from the particle source. The charged toner particles pass through the apertures in the FPC and are subsequently deposited on the information carrier in the configuration of the desired image pattern. The toner particle image is then made permanent by using heat and pressure to fuse the toner particles to the surface of the information carrier.

The variable electric forces applied to the individual control electrodes act either to attract or repel the toner particles positioned on the surface of the particle carrier. The electric forces must be carefully regulated to be above or below a predetermined transport threshold value corresponding to a print mode and a no print mode respectively. The threshold value is strongly dependent on the gap distance between the FPC and the surface of the particle carrier. The gap distance is generally in the order of about 50 microns and may vary within ±5 microns without severely affecting the print quality. Therefore, it is essential to provide a constant and uniform gap distance to maintain high print quality.

Further, when a control electrode is in the print mode, the attractive force must not be changed until the toner particles have gained sufficient momentum to pass through the corresponding aperture in the FPC. The time required for the charged particles to be transported through an aperture is also dependent on the gap distance between the FPC and the surface of the particle carrier.

Accordingly, even very minor variations in the gap distance between the FPC surface and the particle carrier surface may significantly and adversely affect the accuracy of the print control function, resulting in undesired size variation or density variation in the printed dots and degradation of the print readability.

It is desirable to arrange the FPC as closely to the toner carrier as possible without actually contacting the toner layer. Since the gap distance, as mentioned, typically is in the order of about 50 microns, even the slightest mechanical imperfect ions may cause a drastic degradation of the print quality.

One type of particle carrier which is frequently used has the form of a smooth cylindrical sleeve. It is, however, not possible to avoid minor imperfections in the sleeve, and consequently in reality the sleeve is never either perfectly cylindrical or perfectly smooth. In addition to the defects that may be found in the cylindrical sleeve, the layer of toner particles coating the sleeve may have a thickness which is slightly non-uniform. Furthermore, the diameter of the particles themselves may vary and their shape may show deviations from an ideal spherical shape. The given examples illustrate only a few of the numerous irregularities which may cause variations in the actual gap distance found between the FPC and the particle carrier.

A further source of variations in the gap distance is the mounting of the FPC in the print head structure. During the positioning of the FPC in alignment with the particle carrier, the FPC material may be deformed into a slight wave-shape due to non-uniform tension being applied to the material. Likewise, forces arising from the printing process itself may cause deformation which will affect the gap distance. Accordingly, to achieve a minimal, constant and uniform gap distance between the FPC and the particle carrier, while at the same time producing a uniform tension over the whole FPC surface and further to maintain these conditions during the whole print procedure, has proven to be one of the most critical steps of a direct printing method.

To maintain a constant and uniform gap distance between the FPC surface and the particle carrier is particularly important in order to achieve an improved print quality by enhancing the grey scale capability of the print head. The image configuration is formed by a plurality of dots having variable form and/or degree of darkness to create different shades in the range between white and maximal darkness. The control signals can be modulated with high precision to allow a specific amount of toner particles to be transported through each aperture in the FPC, the amount of toner particles transported through each aperture thereby corresponding to a certain grey level or shade. To obtain a satisfying grey scale capability when using a direct printing method, it is thus highly desirable to eliminate or at least considerably reduce the problems associated with irregularities occurring in the gap distance between the FPC and the particle carrier.

Therefore, to ensure a uniform print quality and enhance the grey scale capability of a direct electrostatic printing process, a need has been identified for an improved support device for a control unit in a print head structure offering the required surface evenness, alignment and tension uniformity to the control unit material used in the process.

SUMMARY OF THE INVENTION

The present invention improves the printing quality of a direct electrostatic printing device. The printing device is provided with means for maintaining a constant minimal gap between the print control unit and a particle carrier.

The print head structure according to the invention comprises a support device for supporting a flexible control unit in a predetermined position in the print head structure, the support device being in the form of a rigid trough-shaped frame having a longitudinal dimension and a transverse dimension and further having two longitudinally extending side walls, a bottom portion between said side walls, an outside surface and an inside surface whereby a longitudinally extending slot is provided in the bottom portion of the support device extending through the support device between the inside surface and the outside surface thereof; the support device further comprising means for maintaining said flexible control unit in contact with said bottom portion of the support device, the flexible control unit thereby bridging said slot in said bottom portion.

In a support device or frame according to the invention, very little force is needed in order to accomplish accurate positioning of the control unit in the frame and to keep the control unit in alignment with the slot in the support frame. Accordingly, no deforming tensional forces are created in the flexible control unit either during the positioning step or when printing is being performed.

The frame is basically shaped as a half pipe having an elongated opening or slot corresponding to the print zone of the print head structure. When a flexible control unit is bent and placed inside the frame, the control unit will be forced to resiliently press against the bottom portion of the frame on both sides of the longitudinally extending slot. Since the control unit is flexible, with a certain resiliency, only a comparatively small force is needed to keep the control unit in contact with the inside surface of the frame.

The frame is preferably positioned in the print head structure by means of two guiding holes arranged through the frame at each end of the frame. The holes are excentric and allow the frame to be adjusted in relation to the particle carrier.

The low force exerted by the flexible control unit when pressing against the frame will not cause the frame to deform. Further, since the control unit is, at least to a certain degree, freely floating inside the frame, it is possible for the control unit to expand or contract with changes in temperature and humidity without significantly affecting the position of the print zone. The curvature of the inside surface of the frame should be chosen with regard to the flexibility of the flexible control unit. If the inside surface of the frame has a diameter that is too small, the control unit will adopt a less desired V-shaped cross section within the area of the elongated slot in the frame.

To enable printing through the slot in the frame, the outside surface of frame is preferably milled in the area of the longitudinally extending slot, whereby the frame is provided with a flat surface on the side of the frame facing the information carrier. During printing, the flexible control unit is supported by the frame, and is protected by the frame from physical contact with the information carrier. Hereby, the risk that the control unit will suffer damage during for instance a paper jam in the print head is reduced to a minimum.

The opening or slot in the frame can be made very narrow, whereby the unsupported portion of the control unit is minimized. In other words, the possibility of controlling the exact position of the control unit is very good, as too is the shielding of the control unit from external forces.

To further compensate for the shifting forces that may arise during printing due to the rotational movement of the particle carrier, the support frame is preferably provided with resilient cushioning means which contacts the flexible control unit. Such resilient cushioning means may consist of rubber bearings arranged along the inside surface of the side walls. The resilient cushioning means absorbs any slight vibrations or other movements in the flexible control unit.

An important advantage gained by the invention is that the frame has a very simple construction, and thus offers an economical and yet efficient way to achieve high quality printing. The support frame can be made at comparatively low cost, and the control unit can easily be applied to and fixed inside the frame. Further, the frame is relatively small and can readily be fitted into the print head structure without unduly affecting the size of the print head. The support frame according to the invention may be made from a wide variety of materials. A suitable starting material for the manufacture of a support frame is, for instance, a pipe of plastic material or metal, such as aluminum, whereby the pipe is cut longitudinally in two halves, each half then being provided with a longitudinally extending slot for the print zone. Other ways of manufacturing a frame according to the invention would be by die-casting, moulding or punching.

A print head structure according to the present invention includes a back electrode, a particle carrier, a control unit comprising a control electrode array positioned between the back electrode and the particle carrier. An information carrier such as a sheet of ordinary printing paper can be conveyed through a passage arranged between the back electrode and the control electrode array, whereby charged particles, such as toner, can be deposited onto the information carrier.

The particle carrier comprises at least one rotating cylindrical developer sleeve having a rotational axis extending transversely across a print zone which is arranged perpendicularly to the motion of the information carrier.

The particle carrier delivers charged particles to the information carrier. The charged particles are caused to move from the particle carrier towards the back electrode by the electric field generated by the back electrode, thereby passing through the control electrode array which restricts the amount of particles delivered to the information carrier. The flow of charged particles through any one of a plurality of apertures in the control electrode array can be individually controlled by control electrodes which act on each individual aperture to selectively open or close the aperture during the printing process.

The control electrode array is in the form of a flexible sheet of material having a multitude of apertures therethrough, and further being provided with a printed circuit constituting the control electrodes which regulate the passage of charged particles through the apertures. The control electrode array preferably has a substantially rectangular shape and is in accordance with the invention, fitted inside a rigid support frame which is mounted at a predetermined distance from the particle carrier.

In order to fit into the support frame, the control electrode array is bent along a longitudinal axis, and is placed with the apertures in the array in alignment with a slot in the frame. The edges of the control electrode array is engaged by fixation means arranged on the inside of the support frame. Such fixation means can be in the form of tracks or ridges provided on the inside of the support frame. Alternatively the fixation means can be in the form of clamps, hooks, adhesive or the like.

BRIEF DESCRIPTION OF THE DRAWINGS

The present invention will become more fully understood from the detailed description given hereinbelow and the accompanying drawings which are given by way of illustration only, and thus are not limitative of the present invention and wherein.

DESCRIPTION OF EMBODIMENTS

Figure 1:
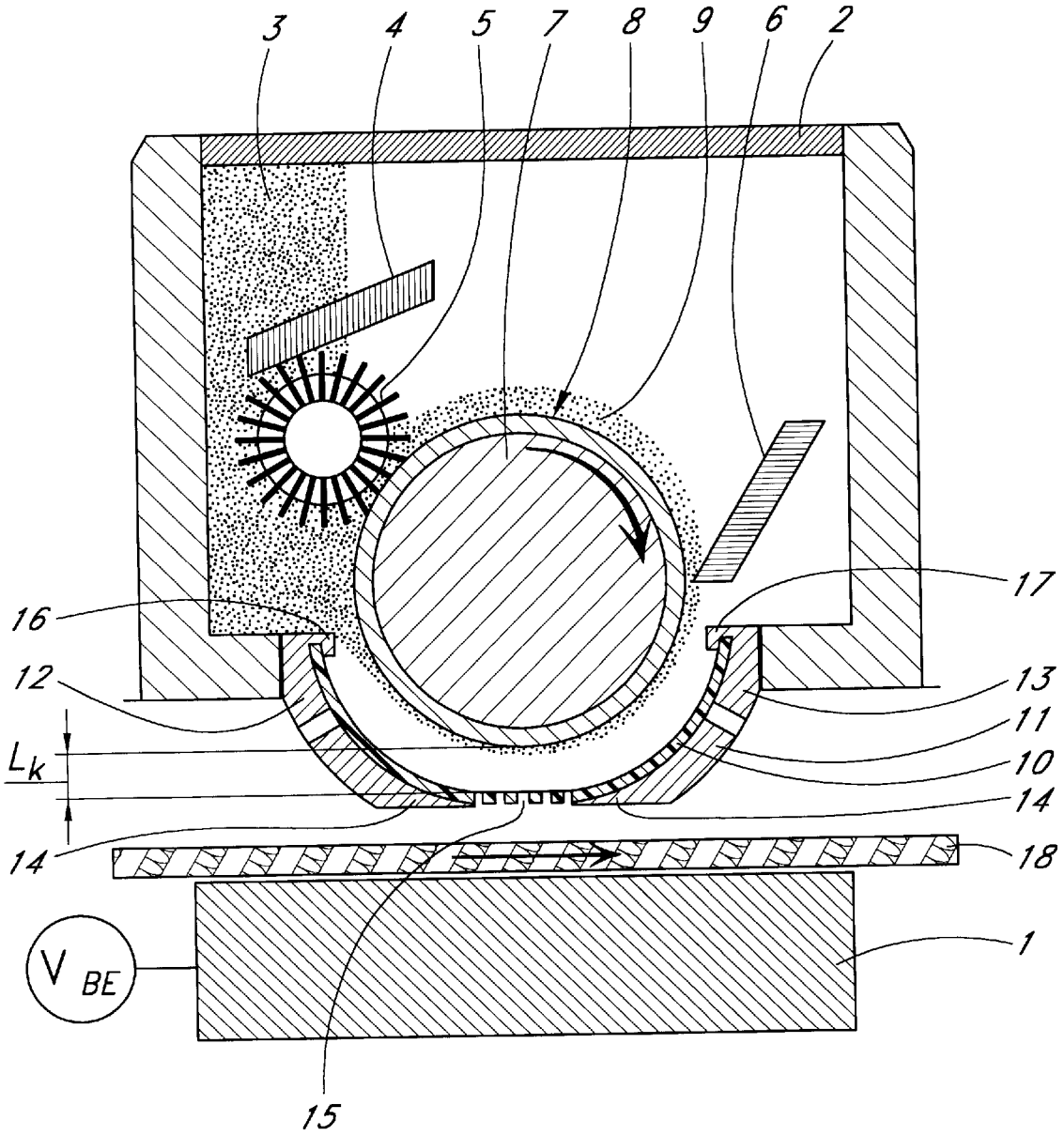
FIG. 1 is a schematic sectional view of a direct printing apparatus.

The direct electrostatic print head structure shown in FIG. 1 includes a back electrode 1 connected to a back voltage source $V_{BE}$, which is placed at a distance from a particle supplying unit 2. The particle supplying unit 2 comprises a particle container 3, a particle feeder 4, a rotating supply brush 5, a metering blade 6 and a rotating developer sleeve 7 having a surface 8 which is coated with a thin layer of uniformly charged toner particles 9.

A control unit or FPC, 10, formed of a rectangular sheet of a flexible substrate of electrically insulating, non-rigid material, is placed in a support frame 11 in the particle supplying unit 2 in order to keep the FPC 10 at a constant, uniform distance $L_k$ from the surface 8 of the developer sleeve 7. The frame 11 is a rigid structure having the shape of a longitudinally dissected cylinder with two side walls 12,13 and a bottom portion 14 between the side walls 12,13. A longitudinally extending slot 15 is arranged in the bottom portion 14 of the frame 11.

The FPC 10 is arranged on the inside of the support frame 11 which is the side of the support frame facing the developer sleeve 7, and is held in position, tensioned against the slot in the frame 11 by fastening flanges 16,17 provided along edges on the inside of the frame 11.

Figure 3:
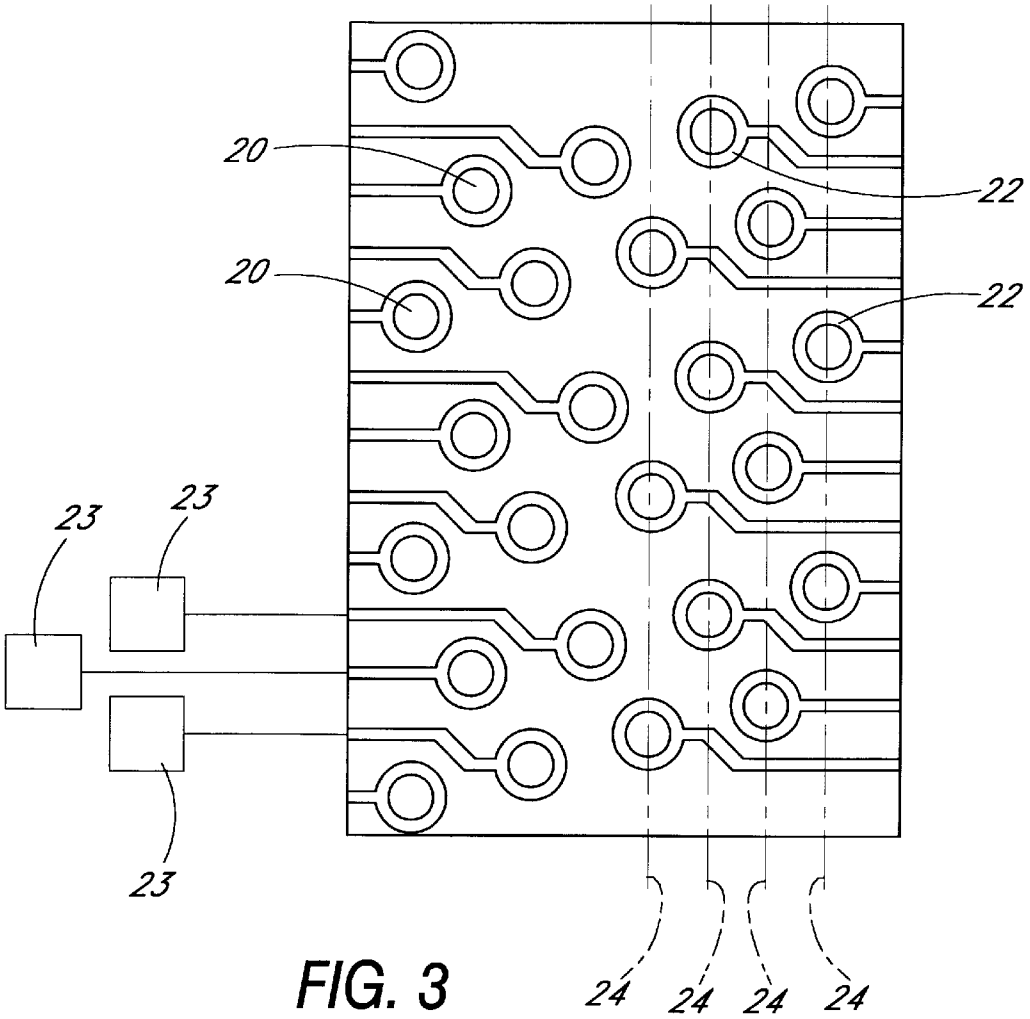
FIG. 3 is an enlarged plan view of the FPC shown in FIG. 2.
Figure 2:
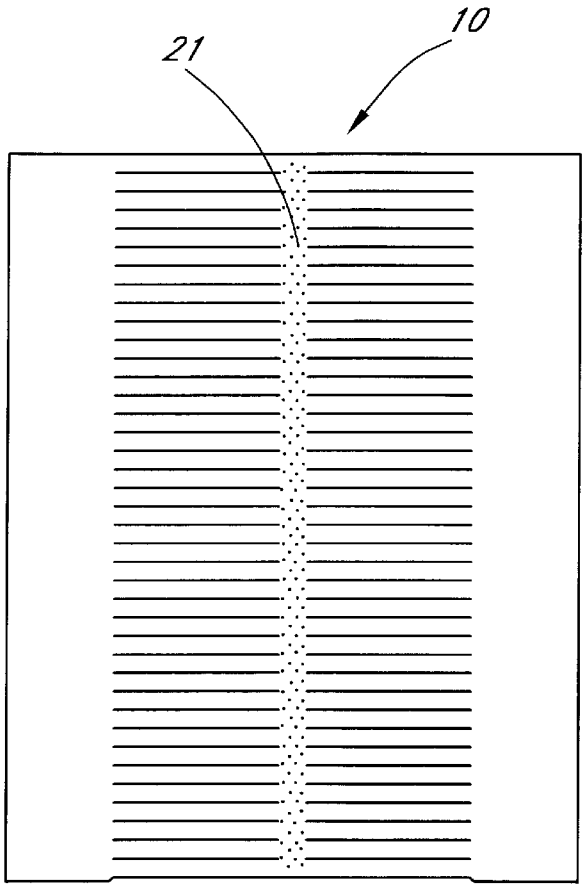
FIG. 2 is a schematic plan view of a control unit (FPC) being part of a printhead structure according to the present invention.

As can best be seen in FIGS. 2 and 3 the FPC 10 has a plurality of apertures 20 arranged within a band-like area 21 through the central part of the substrate to enable particle passage from the developer sleeve surface 8 through the FPC 10 toward the back electrode 1. The apertures 20 are localised to the part of the FPC 10 being positioned in alignment with the slot 15 in the support frame 11. Through the use of the support frame 11, the apertured area 21 of the FPC 10 can thus be maintained at a constant distance $L_k$ from the sleeve surface 8. An information carrier 18, such as a sheet of plain, untreated paper is fed between the FPC, 10 and the back electrode 1 by means of a feeding unit (not shown).

FIG. 3 is an enlarged view of a portion of the apertured band-like area 21 of the FPC 10. The apertures 20 are arranged in parallel rows 24 extending along the band-like area 21. Each aperture 20 is surrounded by a control electrode 22, individually connected to a control signal source 23. The parallel rows 24 of apertures 20 are aligned perpendicularly in a transverse direction to the motion of the information carrier 18, the apertures 20 of each row 24 being staggered in relation to the apertures 20 of neighbouring rows 24, thereby ensuring complete coverage of the information carrier 18 by providing an addressable dot position at every point along any transversal line across the information carrier 18.

Figure 4:
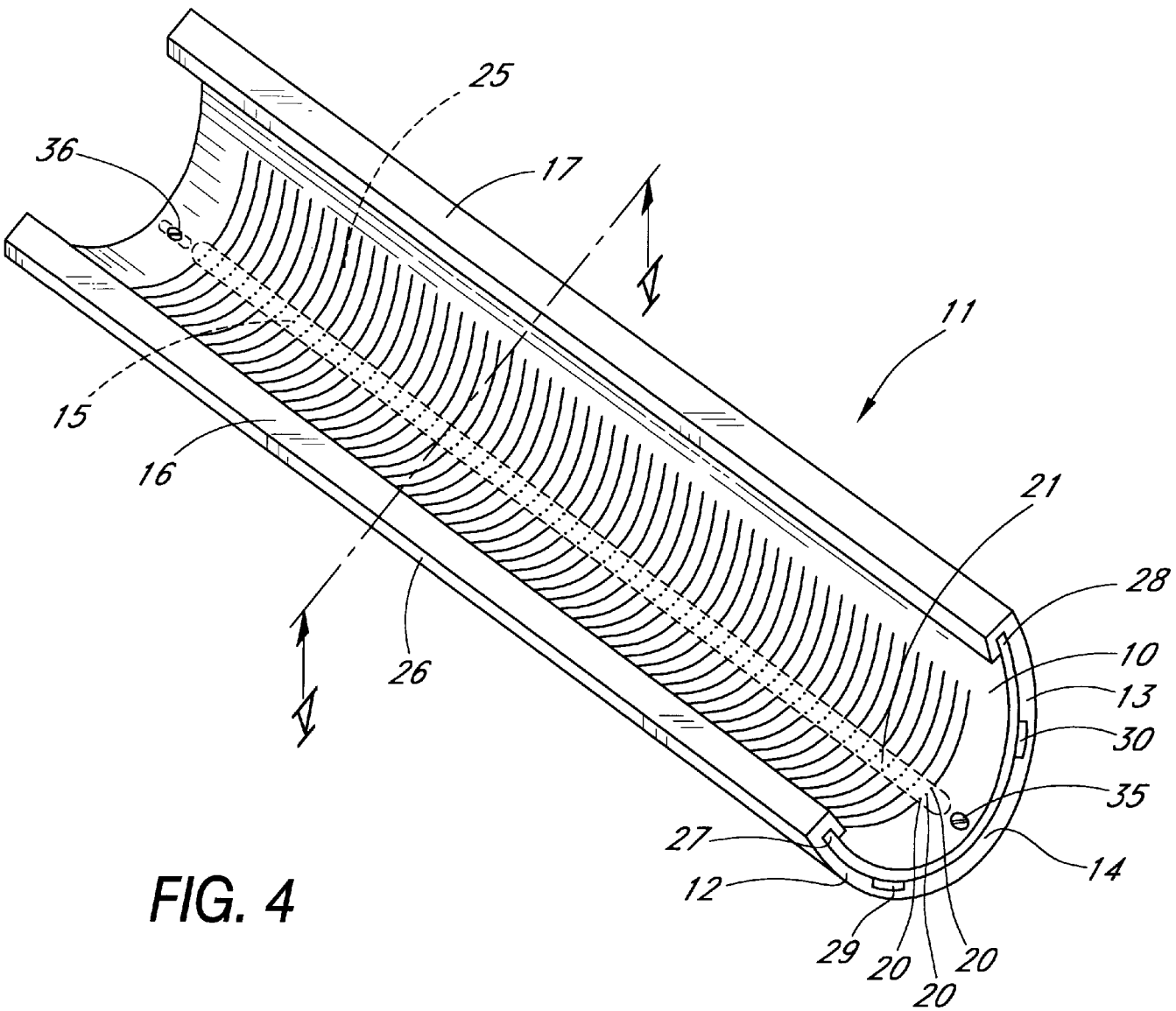
FIG. 4 is a perspective view of a support frame.

The support frame 11 shown in FIG. 4 has the shape of a dissected pipe forming two side walls 12,13 and a bottom portion 14 between the side walls 12,13. Fastening flanges 16,17 for fastening and holding a flexible control unit 10 extend along longitudinal edges of the frame 11. Further, the frame 11 has a longitudinally extending slot 15 arranged through the frame 11 in the bottom portion 14. The frame has an inner surface 25 and an outer surface 26 whereby the inner surface 25 supports a flexible control unit or FPC 10 and the outer surface 26 faces the information carrier 18 when the support frame 11 is mounted in a print head structure such as the one shown in FIG. 1.

The flexible control unit 10, as shown in FIGS. 2 and 3 is applied to the inner surface 25 of the frame 11 and is fastened beneath the fastening flanges 16,17.

When applying the FPC 10 to the frame 11, the FPC is bent along an axis parallel with its central band-like apertured area 21. Thereafter, the FPC 10 is placed in the frame 11 with the longitudinal edges 27,28 of the FPC 10 inserted beneath the flanges 16,17 of the frame 11. During the printing procedure, the FPC 10 is held securely and correctly positioned in the frame 11 by the flanges 16,17. The forces created in the FPC 10 when bending it in order to make it conform to the curvature of the inner surface 25 of the frame 11, act to resiliently keep the FPC 10 pressed against the bottom portion 14 of the frame 11 without causing deformation of the FPC 10.

Resilient dampening means 29,30 such as longitudinally extending rubber bearings, leaf springs or the like are arranged on the inner surface 25 of the side walls 12,13. The resilient dampening means 29,30 act to absorb any slight vibrations or tensional stress that might occur in the FPC 10 during printing. Further, temperature changes may cause the FPC 10 to expand or contract in a transverse direction. Such movements are continuously compensated by the resilient dampening means 29,30 which will yield or spring back when subjected to changing forces from the FPC 10.

In order to keep the apertured area 21 of the FPC in alignment with the slot 15 in the bottom portion 14 of the frame 11 and prohibit transversal movement of the FPC 10, the FPC 10 is preferably attached to the bottom portion of the frame 11. The attachment means 35,36 are arranged at each end of the longitudinally extending slot 15 in the frame 11. At one end of the slot the FPC 10 is firmly fixed to the frame 11 while the attachment means 36 at the other end of the slot 15 consist of a bolt or a screw running through a longitudinally oriented oblong hole in the frame 11, thereby allowing slight movement of the FPC 10 in the longitudinal direction only.

The FPC 10 is positioned in the frame 11 with the apertured, band-like area 21 in alignment with the slot 15 in the frame 11. The area 21 thereby corresponds to the print zone of a print head structure. Electrostatically charged particles, such as toner, may selectively and in a controlled manner be directed through the apertures in the FPC 10 and the slot 15 in the frame 11 in order to create an image on an information carrier passing through the print zone.

Figure 5:
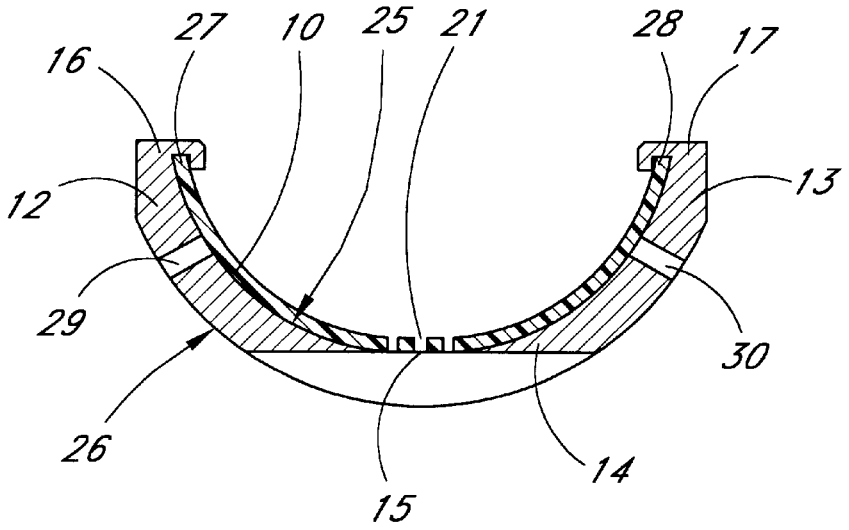
FIG. 5 is a cross-section through the support frame of FIG. 4.

As can be seen in FIG. 5, the bottom portion 14 of the outer surface 26 of the frame 11 has been milled flat to minimize the distance between the FPC 10 and an information carrier passing beneath the slot 15 in the frame 11.

Figure 6:
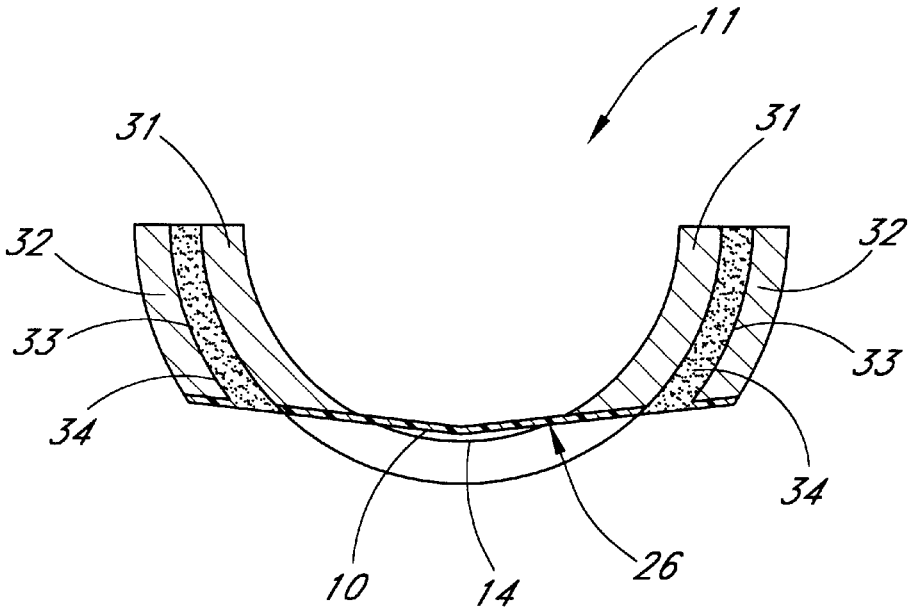
FIG. 6 is a cross-section through a support frame according to an alternative embodiment of the invention.

The support frame 11 shown in cross section in FIG. 6 is an alternative embodiment of the invention. The support frame 11 comprises two concentric trough-shaped parts 31,32 whereby the inner part 31 has a smaller radius of curvature than the outer part 32. The FPC 10 is positioned in a gap 33 between the two parts of the frame and is held in place by means of an adhesive 34 which fills out the gap 33. Similarly to the frame 11 shown in FIGS. 4 and 5, the outer surface 26 of the frame 11 shown in FIG. 6 has an essentially flat bottom portion 14 intended to be facing an information carrier during printing.

The support frame 11 of FIG. 6 provides excellent shielding of the FPC against damage, and offers an efficient way of fastening the FPC without the need of subjecting it to deforming tensional forces.

From the foregoing it will be recognized that numerous variations and modifications may be effected without departing from the scope of the invention as defined in the appended claims.

I claim:

1. A print head structure comprising a support device for supporting a flexible control unit in a predetermined position in said print head structure, the support device being in the form of a rigid trough-shaped frame having a longitudinal dimension and a transverse dimension and further having two longitudinally extending side walls, a bottom portion between said side walls, an outer surface and an inner surface, the bottom portion of said support device having a longitudinally extending slot which extends through the support device between the inner surface and the outer surface thereof; the support device further comprising fastening means for maintaining said flexible control unit in resilient contact with said inner surface and said bottom portion of the support device, the flexible control unit thereby bridging said slot in said bottom portion.

2. The print head structure of claim 1, wherein the flexible control unit comprises a printed circuit.

3. The print head structure of claim 2, wherein the flexible control unit comprises a substrate of nonrigid material overlaid with a plurality of control electrodes for generating a pattern of electrostatic fields.

4. The print head structure of claim 3, wherein the flexible control unit comprises a control array provided with a plurality of apertures arranged therethrough, each aperture being at least partially surrounded by at least one control electrode to allow controlled passage of charged particles through said apertures in the flexible control unit.

5. The print head structure of any one of the preceding claims, wherein the flexible control unit comprises an electrically insulating, flexible substrate.

6. The print head structure of claim 4, wherein the apertures in the flexible control unit are aligned with the slot in said bottom portion of the frame.

7. The print head structure of claim 1, wherein the means for maintaining said flexible control unit in contact with said bottom portion of the support device comprises means for tensional engagement between the flexible control unit and the support device.

8. A print head structure comprising a support device for supporting a flexible control unit in a predetermined position in said print head structure, the support device being in the form of a rigid trough-shaped frame having a longitudinal dimension and a transverse dimension and further having two longitudinally extending side walls, a bottom portion between said side walls, an outer surface and an inner surface, the bottom portion of said support device having a longitudinally extending slot, which extends through the support device between the inner surface and the outer surface thereof; the support device further comprising fastening means for maintaining said flexible control unit in contact with said bottom portion of the support device, the flexible control unit thereby bridging said slot in said bottom portion, wherein the fastening means is in the form of longitudinally extending ridges arranged on the side walls on the inner surface of the support structure.

9. A print head structure comprising a support device for supporting a flexible control unit in a predetermined position in said print head structure, the support device being in the form of a rigid trough-shaped frame having a longitudinal dimension and a transverse dimension and further having two longitudinally extending side walls, a bottom portion between said side walls, an outer surface and an inner surface, the bottom portion of said support device having a longitudinally extending slot, which extends through the support device between the inner surface and the outer surface thereof; the support device further comprising fastening means for maintaining said flexible control unit in contact with said bottom portion of the support device, the flexible control unit thereby bridging said slot in said bottom portion, wherein the support device comprises an inner part and an outer part, the inner part having a smaller radius of curvature than the outer part; and further wherein the flexible control unit is arranged in a gap between the inner part and the outer part, the means for maintaining said flexible control unit in contact with said bottom portion of the support device comprising adhesive.

10. A print head structure comprising a support device for supporting a flexible control unit in a predetermined position in said print head structure, the support device being in the form of a rigid trough-shaped frame having a longitudinal dimension and a transverse dimension and further having two longitudinally extending side walls, a bottom portion between said side walls, an outer surface and an inner surface, the bottom portion of said support device having a longitudinally extending slot, which extends through the support device between the inner surface and the outer surface thereof; the support device further comprising fastening means for maintaining said flexible control unit in contact with said bottom portion of the support device, the flexible control unit thereby bridging said slot in said bottom portion, wherein the means for maintaining said flexible control unit in contact with said bottom portion of the support device comprises clamps.

11. The print head structure of claim 10, wherein said clamps comprise screws.

12. A print head structure comprising a support device for supporting a flexible control unit in a predetermined position in said print head structure, the support device being in the form of a rigid trough-shaped frame having a longitudinal dimension and a transverse dimension and further having two longitudinally extending side walls, a bottom portion between said side walls, an outer surface and an inner surface, the bottom portion of said support device having a longitudinally extending slot, which extends through the support device between the inner surface and the outer surface thereof; the support device further comprising fastening means for maintaining said flexible control unit in contact with said bottom portion of the support device, the flexible control unit thereby bridging said slot in said bottom portion, wherein the means for maintaining said flexible control unit in contact with said bottom portion of the support device comprises guide means such as flanges or slots.

13. A method for positioning a flexible control unit in a print head structure, said print head structure comprising a trough-shaped support frame having an inner surface, an outer surface, two side walls and a bottom portion between the side walls, wherein a slot is provided through the bottom portion of the support frame, the method comprising the steps of bending the control unit in conformance with the inner surface of the support device, applying the bent control unit to the inner surface of the support device, bringing the control unit in alignment with the slot in the support device and fastening the control unit to the support device by providing means for maintaining the flexible control unit in resilient contact with said inner surface and said bottom portion of the support device.

14. A print head structure for direct electrostatic printing, comprising:

a back electrode;

a particle carrying unit for conveying charged particles to a particle source positioned adjacent to the back electrode;

a control unit interposed between the back electrode and the particle carrying unit for converting a stream of electronic signals, defining an image information, to a pattern of electrostatic fields that selectively permit or restrict the transport of said charged particles from the particle source toward the back electrode;

a support device for supporting the control unit in a predetermined position in said print head structure, the support device being in the form of a rigid trough-shaped frame having a longitudinal dimension and a transverse dimension and further having two longitudinally extending side walls, a bottom portion between said side walls, an outer surface and an inner surface, said bottom portion of said support device having a longitudinally extending slot which extends through the support device between the inner surface and the outer surface thereof; the support device further comprising fixation means for tensionally maintaining said flexible control unit in resilient contact with said inner surface and said bottom portion of the support device, the flexible control unit thereby bridging said slot in said bottom portion.

15. A support device for supporting a flexible control unit in a predetermined position in a print head structure, the support device comprising:

a rigid trough-shaped frame having a longitudinal dimension and a transverse dimension and further having two longitudinally extending side walls, a bottom portion between said side walls, an outer surface and an inner surface, said bottom portion of said frame device having a longitudinally extending slot which extends through the frame between the inner surface and the outer surface thereof; and fastening means for maintaining said flexible control unit in resilient contact with said inner surface and said bottom portion of the frame, the flexible control unit thereby bridging said slot in said bottom portion.

* * * * *